US007868250B2

(12) United States Patent
Kolada

(10) Patent No.: US 7,868,250 B2
(45) Date of Patent: Jan. 11, 2011

(54) POWER SUPPLY AND CORD MANAGEMENT APPARATUS FOR ELECTRONIC DEVICES

(75) Inventor: Paul Kolada, Bexley, OH (US)

(73) Assignee: Priority Worx, LLC, Columbus, OH (US)

( * ) Notice: Subject to any disclaimer, the term of this patent is extended or adjusted under 35 U.S.C. 154(b) by 445 days.

(21) Appl. No.: 11/832,000

(22) Filed: Aug. 1, 2007

(65) Prior Publication Data

US 2008/0029428 A1 Feb. 7, 2008

Related U.S. Application Data

(60) Provisional application No. 60/834,706, filed on Aug. 1, 2006.

(51) Int. Cl.
*H01H 9/02* (2006.01)

(52) U.S. Cl. ..... 174/53; 174/50; 174/135; 220/3.2; 220/3.3; 385/134; 385/135

(58) Field of Classification Search ..... 174/480, 174/481, 50, 53, 57, 58, 66, 67, 17 VA, 17 R, 174/135, 59; 220/3.2–3.9, 4.02, 241, 242; 248/906; 385/134, 135; 361/600, 643, 601, 361/641, 679.01, 724; 439/535, 536, 501; D13/199, 173

See application file for complete search history.

(56) References Cited

U.S. PATENT DOCUMENTS 4,931,978 A 6/1990 Drake et al.
5,547,393 A 8/1996 Jansen
5,899,761 A 5/1999 Crane et al.
5,924,892 A * 7/1999 Ferracina ..... 439/501
6,017,228 A 1/2000 Verbeek et al.
6,179,665 B1 1/2001 Rossman et al.
D445,766 S * 7/2001 Solomon ..... D13/199
6,278,063 B1 * 8/2001 Conrad ..... 174/67
6,329,597 B1 12/2001 Kaloustian
6,362,951 B1 * 3/2002 Moribe et al. ..... 174/17 VA
6,396,990 B1 * 5/2002 Ehn et al. ..... 385/135
6,591,952 B1 7/2003 Randall
6,774,603 B2 8/2004 Liao
6,844,494 B1 1/2005 Nevins
7,038,126 B2 * 5/2006 Solet ..... 174/50
7,435,901 B2 * 10/2008 Mori et al. ..... 174/53
2002/0134570 A1 9/2002 Franklin-Lees et al.
2005/0007070 A1 1/2005 Webb et al.

* cited by examiner

*Primary Examiner*—Angel R Estrada
(74) *Attorney, Agent, or Firm*—Jason H. Foster; Kremblas & Foster

(57) ABSTRACT

An electronic device support having a surface upon which electronic devices rest, such as a shelf, and one or more power sockets into which the power cord for the device is plugged. A first embodiment has a shelf, a rear panel and a moveable façade covering over a power strip. A second embodiment has a shelf, a body with a pair of power sockets and a pair of ears on opposite ends that cords can be wrapped around. The ears are removable and have a female, non-powered socket therein. A third embodiment has a deck shelf and a base with a power strip mounted therebetween. Apertures in the deck permit cords and other items to be inserted therethrough, and a groove on the deck prevents rolling of items. A fourth embodiment has a tower body with a plurality of moveable shelves, a plurality of electrical sockets and channels for hiding cords.

5 Claims, 15 Drawing Sheets

POWER SUPPLY AND CORD MANAGEMENT APPARATUS FOR ELECTRONIC DEVICES

CROSS-REFERENCES TO RELATED APPLICATIONS

This application claims the benefit of U.S. Provisional Application No. 60/834,706 filed Aug. 1, 2006.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to devices into which electronic devices and their charging cords can be plugged, and more particularly relates to a power supply and cord management device which support the electronic devices during charging.

2. Description of the Related Art

It is very common for people to carry or use a mobile telephone, personal digital assistant (PDA), personal listening device (e.g., the iPod brand MP3 player) and other electronic devices. Such devices have batteries that, after a certain period of use, need to be connected to electrical power for charging. Typically, a person with such devices plugs them in at a central location, such as a bedside or kitchen countertop, for charging in the evening when he or she returns home for the day. The devices are then fully charged when they are needed.

Because people carry so many such devices, it is common for the cords used to charge the devices to become entangled in the central location, or at least to become an unorganized and unsightly collection of wires and connected transformers. For an organized person, such a situation is unacceptable. However, the common alternative of repeatedly organizing the cords after use is a time-consuming task.

Therefore, the need exists for a device upon which one or more electronic devices can rest while charging, and with which a person can gain some organization over the collection of cords.

BRIEF SUMMARY OF THE INVENTION

It is therefore the purpose of this invention to provide an apparatus for supporting a variety of electronic devices during charging, as well as for organizing and managing the power cords of those devices.

In accordance with the purposes of this invention, there is provided in one embodiment a shelf and a rear panel that are joined along an edge to form a frame that is preferably L-shaped. A façade is pivotably attached to the frame to form a housing having an accessible interior chamber. A power outlet is mounted to the rear panel within the interior chamber. There are preferably a plurality of fingers, formed from portions of the rear panel that are cut and bent, extending into the interior chamber for holding the power cord of the power outlet. The power cords of electronic devices sitting on the shelf extend to the power outlet through a plurality of apertures formed in the shelf. The rear panel has several apertures formed in it for mounting the apparatus to a structure, such as a wall or a cabinet. The power cord of the power outlet preferably extends to a conventional wall outlet.

In a second embodiment of the invention, a main body has at least one electrical socket formed in its front surface. The socket is electrically connected to a power source, preferably through a cord that extends from the main body to a power source. A small shelf is rigidly mounted to the main body, preferably by an upright that extends from the top of the main body. A rear lip preferably extends upwardly from the surface of the shelf to prevent items from falling off the back of the shelf. A concave front lip that is shorter than the rear lip also preferably extends outwardly and upwardly from the periphery of the shelf to prevent items from falling off the front of the shelf. Preferably, the front lip has several slits formed in it for retaining and separating the power cords of devices seated on the shelf.

Preferably, elongated ears extend outwardly from either side of the main body. Each ear has a base, a shaft, and a skirt. The base is removably mounted to the main body and the shaft extends from the base to the skirt. The base and the skirt extend radially outwardly farther than the shaft, thereby creating a groove between the base and the skirt for wrapping the excess length of an electronic device's power cord around. Each ear preferably has an internal socket formed in it that is substantially the same size and shape as the sockets formed on the front of the main body, but that is not electrically connected. This internal socket accommodates the plug of an electronic device when the ear is removed from the main body so that the device can be moved about without the power cord dangling or unraveling from the shaft.

In a third embodiment of the invention, a shelf and a base are connected along a curved spine to define an inner chamber. There is preferably a finger, formed from a portion of the base that is cut and bent, extending into the inner chamber. A power outlet mounts in the chamber, and preferably to the finger. The power cords of electronic devices sitting on the shelf extend to the power outlet through a plurality of apertures formed in the shelf. There is preferably a concave groove formed in the top surface of the shelf for retaining items that are prone to roll or slide. Additionally, there is preferably a layer of high friction, shock absorbent material mounted to the top surface of the shelf.

In a forth embodiment of the invention, an elongated tower has at least one, and preferably a plurality of, electrical sockets formed in its lower end. Each socket is electrically connected in a conventional manner to a main power source that is preferably a power cord that extends from the rear of the tower to a conventional wall outlet.

A plurality of shelves are removably mounted to a vertical slot in the front of the tower, each shelf preferably capable of being adjusted to any position along the slot. Each shelf has a concave front lip that extends outwardly and upwardly from its periphery for preventing items from falling off the front of the shelf. Preferably, the lip has several slits formed in it for retaining and separating the power cords of devices seated on the shelf.

It is preferred to have a plurality of vertical grooves formed in the front of the tower, each groove having a movable cover, for accepting and retaining the power cords of devices seated on the shelves and routing them down to the electrical sockets.

Several apertures are preferably formed in the rear of tower for mounting the apparatus to a structure, such as a wall or a cabinet. Intersecting, perpendicular grooves are preferably formed in the rear of the tower for accepting the main power cord and plug so that the tower can sit flush against the structure to which it is mounted without interference from the cord or the plug.

Figure 1:
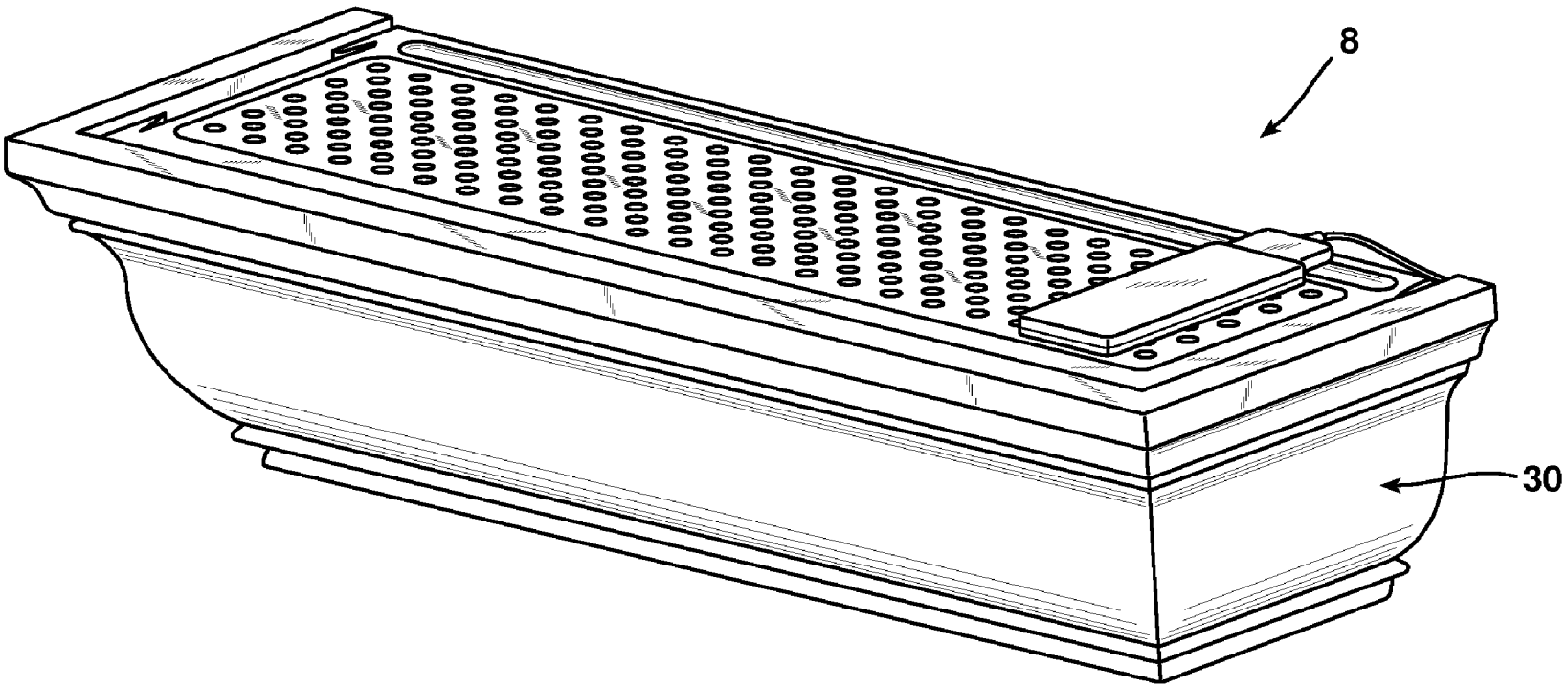
FIG. 1 is a view in perspective illustrating a first embodiment of the invention in a closed position.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 2:
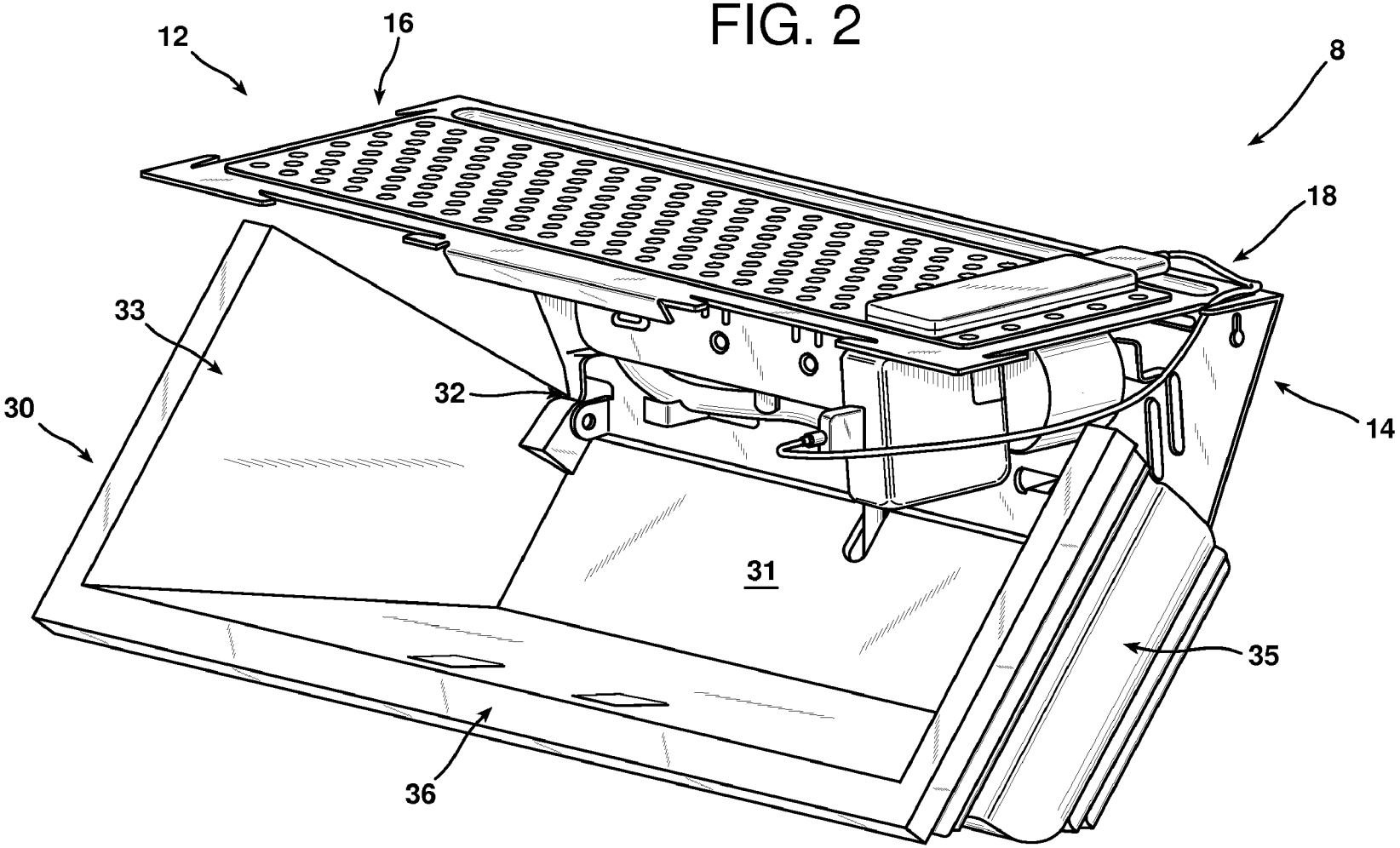
FIG. 2 is a view in perspective illustrating the embodiment of FIG. 1 in an open position.
Figure 3:
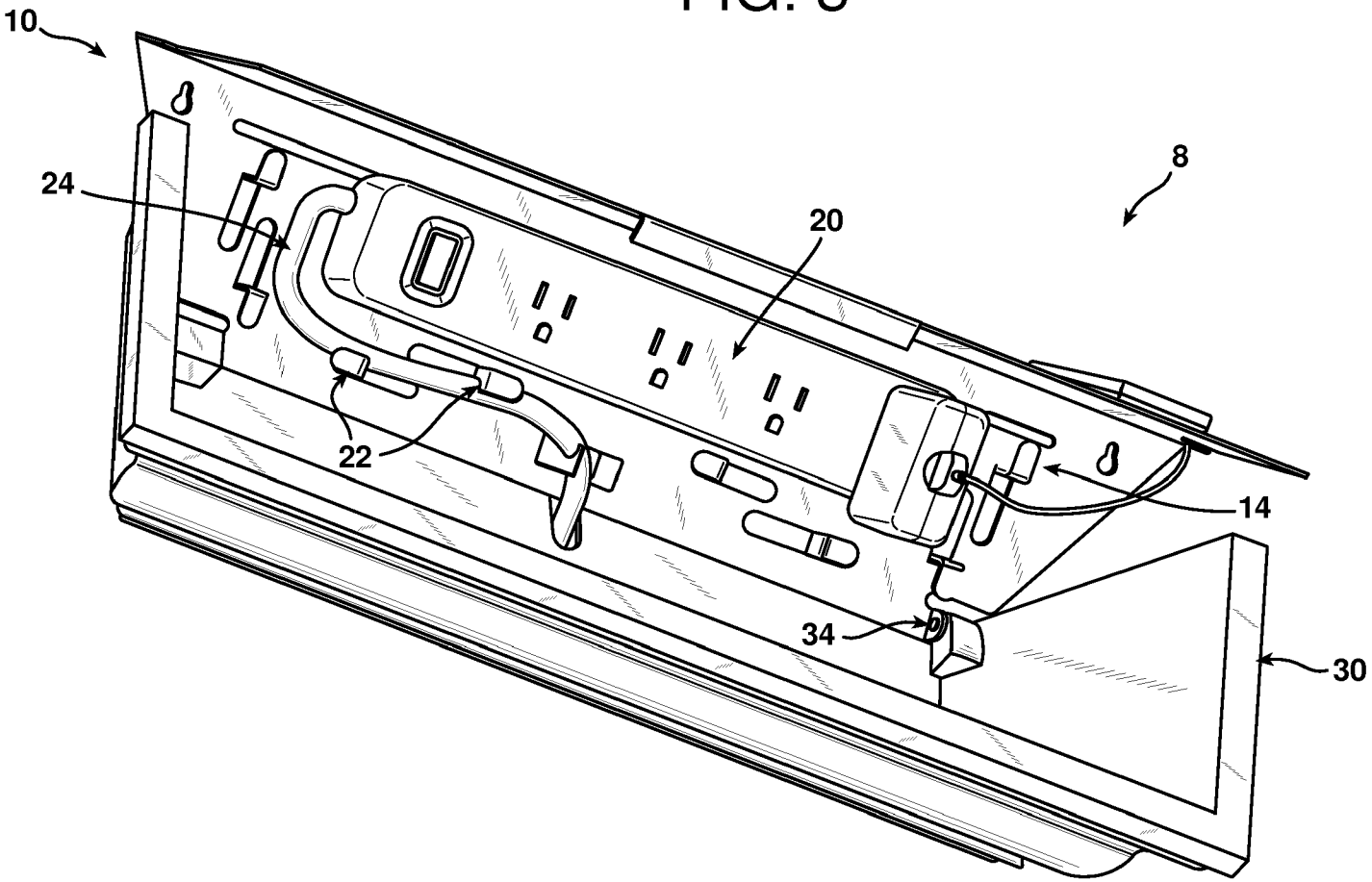
FIG. 3 is a view in perspective illustrating the embodiment of FIG. 1 in an open position.

A first embodiment of the present invention is illustrated in FIGS. 1-3. The support 8 has a frame 10 that is L-shaped and made up of a shelf 12 and a rear panel 14 joined along an intersection. The frame 10 is preferably a sheet steel plate that is bent along the intersection into the shape shown. Of course, other materials and manufacturing methods can be used to form the frame 10.

The shelf 12 preferably has a plurality of apertures formed through it. The apertures can be used for extending narrow structures, such as wires, through the shelf 12, for ventilation, to reduce the weight of the frame 10 or for other reasons that will become apparent to the person having ordinary skill. Likewise, the rear panel 14 has apertures and slots for the same purposes, and also to enable insertion of fasteners, such as screws, hooks and nails, for attachment of the frame 10 to a wall, cabinet or other structure. When the support 8 is so attached, the shelf 12 is preferably horizontally oriented so that items can be placed on the shelf 12 without rolling off under the influence of gravity.

A conventional power strip 20 is mounted to the rear panel 14, and a plurality of bent fingers 22 are formed in the rear panel 14 to hold the power cord 24 in place (see FIG. 3). The fingers 22 are formed from portions of the rear panel 14 that have been cut and bent outwardly, but other methods of forming the fingers 22 are contemplated. The power cord 24 extends to a conventional wall outlet or other source of power from electrical connection to the power strip 20. It is contemplated that the cord 24 can alternatively be wired directly into a conventional electrical system. Thus, any device plugged into one of the outlets of the power strip 20 will be connected in a conventional manner to the source of electrical power to which the cord 24 is connected.

A façade member 30 is pivotably mounted to the rear panel 14 at the tabs 32 and 34 that extend outwardly from the rear panel 14. A magnetic latch, hook, clasp or other conventional latching means keeps the façade member 30 closed (as shown in FIG. 1) when desired.

The façade member 30 forms a hollow chamber 31 defined by the endwalls 33 and 35 and the sidewall 36 and the frame 10. The shelf 12 has slots 16 and 18 (see FIG. 2) through which cords from electrical devices can extend to reach the power source when the façade member 30 is in the closed position shown in FIG. 1. The chamber 31 provides space for the cords that extend from the shelf 12 through the slots 16 and 18, and the façade member 30 covers the cords and the power strip 20 when the façade member 30 is in the closed position.

The façade member 30 has a particular exterior contour that is not critical for the operation of the invention but preferably has a decorative exterior. This contour can be altered, for example, so that the exterior surface is flat, rounded, or has one of various other shapes that will be apparent from the description herein.

In use, the support 8 is mounted to a wall or other vertical structure, and electronic devices such as a mobile telephone and a PDA are placed upon the upwardly facing surface of the shelf 12. Preferably a pliable, high friction material such as urethane or rubber is mounted on the shelf 12 to reduce the shock to devices placed thereon and to prevent slippage off the shelf 12. The façade member 30 is opened to plug the cord for the devices into a socket on the power strip 20, and the cord is woven through one of the slots 16 or 18. It is contemplated that any extra cord length can be wound around fingers, such as the fingers 22, or other structures extending from the rear panel 14 in order to organize the cord. The façade member 30 can be closed and the device plugged into its power cord for charging while resting on the shelf 12. After charging, the device can be unplugged and the power cord will simply stay on the top surface of the shelf 12. When it is desired to recharge the device, the façade member 30 need not be opened again, because the cord is already resting upon the shelf 12. The remainder of the cord is hidden behind the façade member 30 so that the overall support 8 and the device with the cord have a very organized, neat appearance.

A second embodiment of the invention is shown in FIGS. 4-8. The support 108 has a main body 120 in which are formed two conventional household current sockets 121 and 122 (see FIG. 8). The sockets connect electrically in a conventional manner to the cord 124 extending out of the lower end of the body 120. The cord 124 extends to a conventional wall outlet or other source of power. It is contemplated that the cord 124 can alternatively be wired directly into a building's conventional electrical system. Thus, any device plugged into one of the sockets 121 and 122 will be connected in a conventional manner to the source of electrical power to which the cord 124 is connected.

The main body 120 also has a rear panel 130 (see FIG. 5) with means for mounting the body 120 to a wall, cabinet, desk or any other supportive vertical surface. Preferably the mounting means are keyhole apertures 132 and 134 (see FIG. 5) for mounting over nails or screws mounted into the wall. Of course, any alternative mounting means that strongly attaches the body 120 would suffice.

A shelf 112 is rigidly mounted to the top of the main body 120 by an upright 116 that extends from the main body 120 to the underside of the shelf 112. The rear lip 114 extends upwardly from the shelf 112 to provide back support for items placed on the shelf 112. A flexible lip 118 is formed on the periphery of the shelf 112, preferably from rubber, urethane or other high friction, flexible material. The lip 118 forms a concavity on the shelf 112 to prevent small items from rolling off the shelf 112. The shelf 112, upright 116 and rear lip 114 are preferably integral with one another, preferably formed as a single unit, such as by injection molding, and are fastened to the body 120. It will be apparent that these structures can be made in another manner while still accomplishing the purpose described below.

Two ears 140 and 142 are removably mounted on opposing ends of the main body 120. The ears 140 and 142, which are identical, have a base (the base 143 is shown only on the ear 140 in FIG. 7, but an identical base is formed on the ear 142). The base 143 is mounted to the main body 120 when the ear is in an operable position (see FIG. 5). The ears 140 and 142 also have skirts (the skirt 145 is shown on the ear 140 in FIG. 7, and an identical skirt is formed on the ear 142) with a circumferential groove 147 formed between the base and the skirt of each ear (the groove 147 on the ear 140 is identical to the groove of the ear 142) around a shaft that extends between the base and the skirt. The base and skirt extend radially outwardly farther than the shaft, thereby forming the groove between the base and the skirt. Cords can be wound around the ears 140 and 142 at the grooves, as illustrated on the ear 142, in order to take up extra cord length between the electronic device on the shelf 112 and the outlets 121 and 122.

Figure 6:
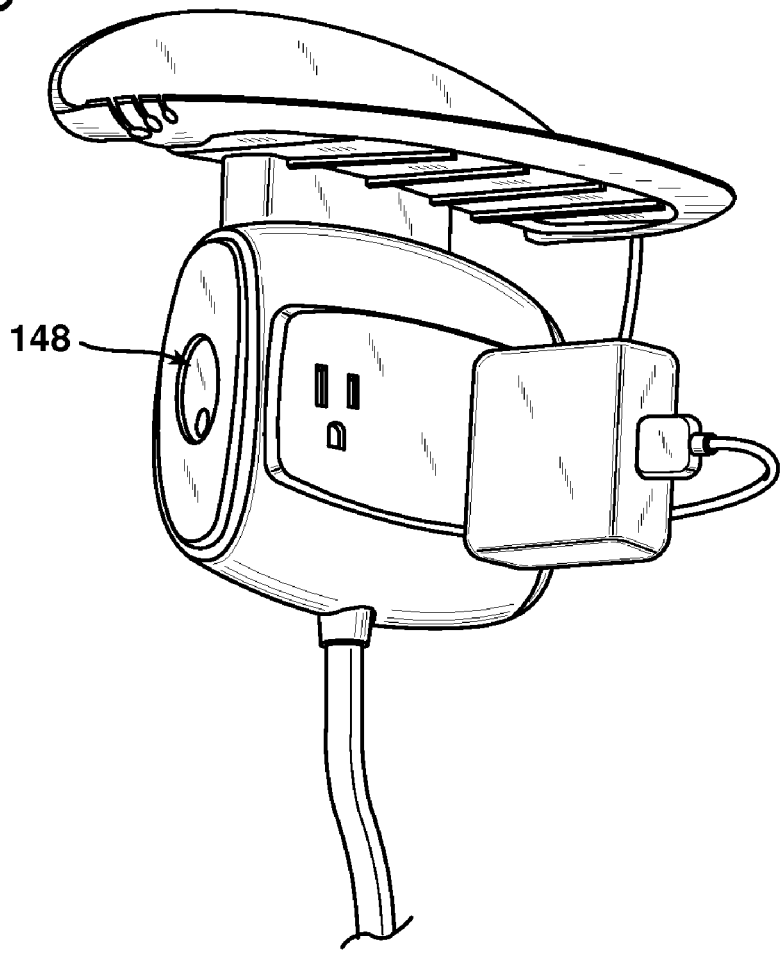
FIG. 6 is a view in perspective illustrating the embodiment of FIG. 4 with one ear removed.
Figure 7:
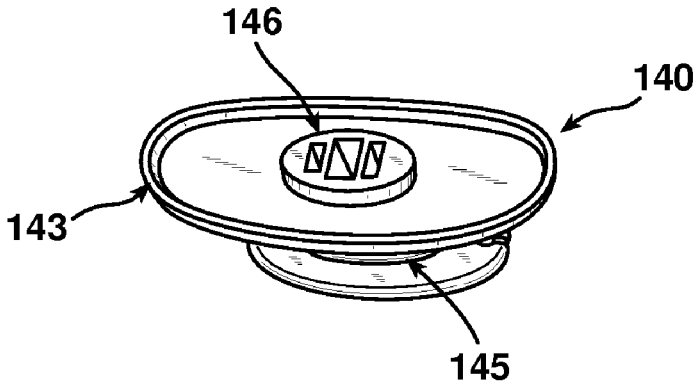
FIG. 7 is a view in perspective illustrating the ear of the FIG. 4 embodiment.
Figure 8:
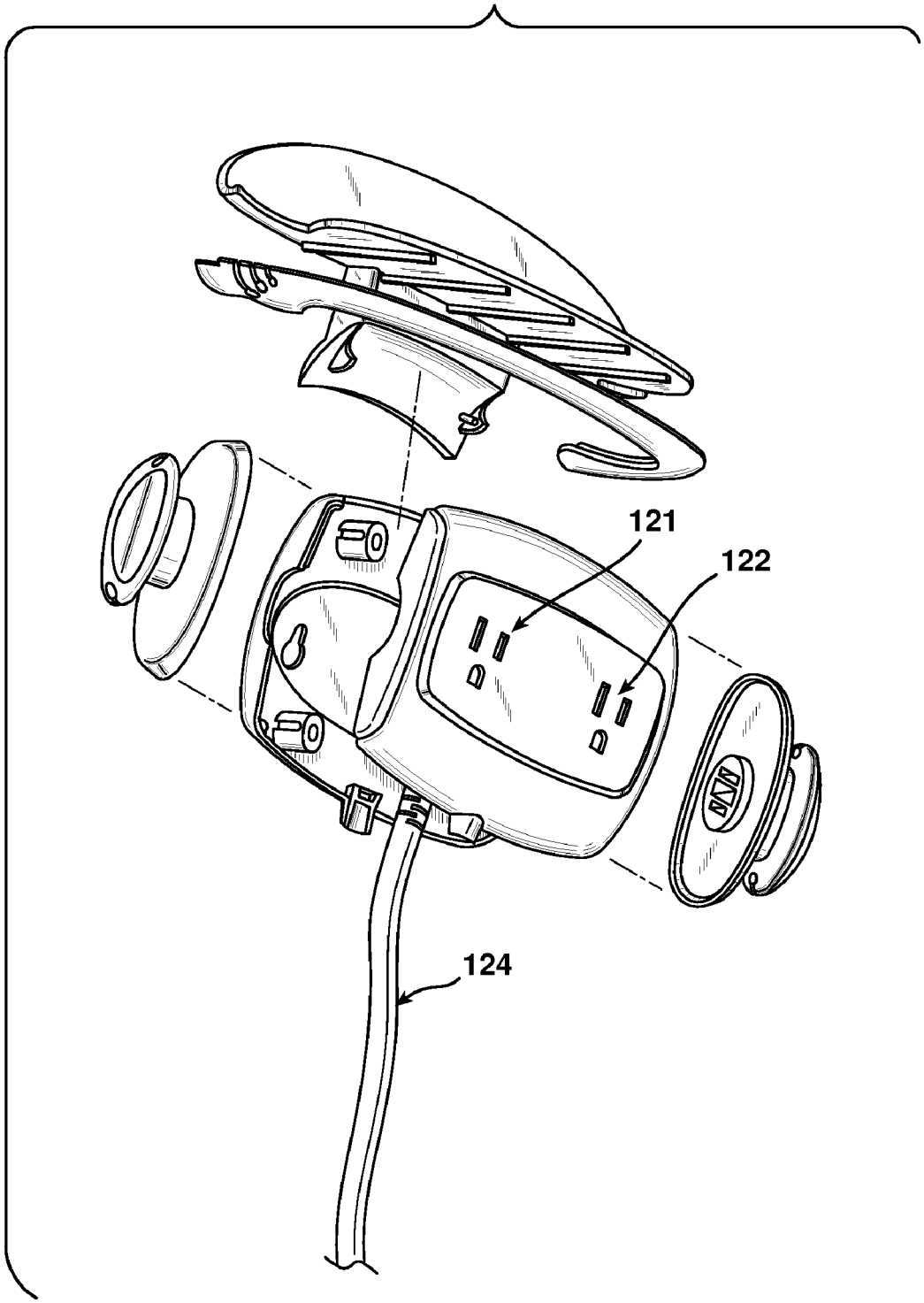
FIG. 8 is an exploded view illustrating the embodiment of FIG. 4.

The ears 140 and 142 are removably mounted to the main body 120, such as by frictional engagement with the end 148 of the main body 120 (see FIG. 6). Alternatively, the ears 140 and 142 can be mounted by other means, including fasteners, such as snaps, clasps and magnets.

The ear 140 has an internal socket 146 (see FIG. 7) that is substantially identical to the shape and size of at least a portion of the sockets 121 and 122. An identical socket is formed in the ear 142. The socket 146 is not connected to a source of electrical power, and the plug or transformer of a cord for an electronic device can be plugged into the socket 146 when the ears 140 and 142 are removed from the main body 120. Such a configuration is very convenient for the traveler who wishes to remove the cord from the support 108 without unwinding it from the ear 140 or 142. This thereby helps the cord in a compact configuration and protects the plug and the surrounding objects from harm caused by the plug prongs.

Figure 9:
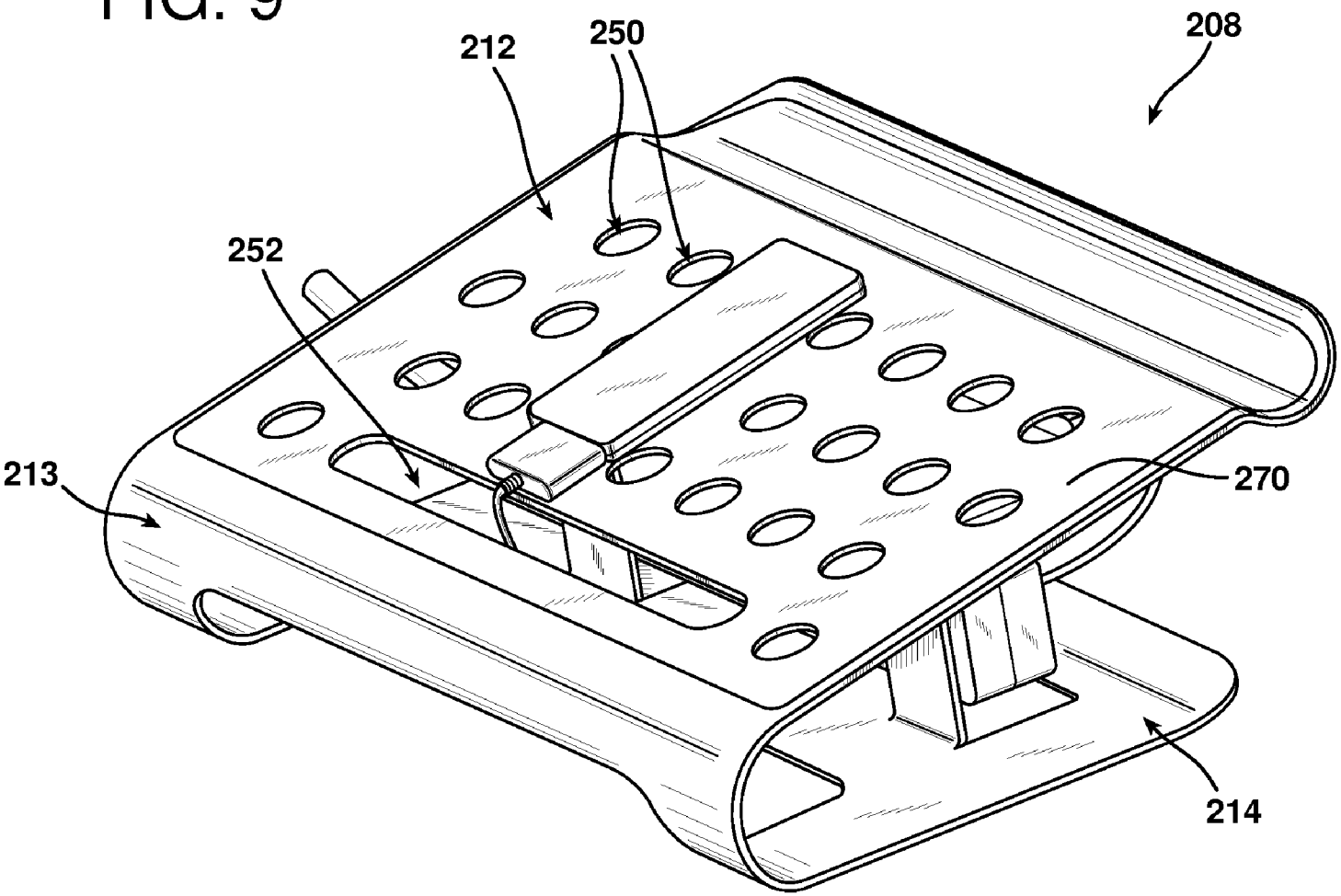
FIG. 9 is a view in perspective illustrating a third embodiment of the present invention.
Figure 10:
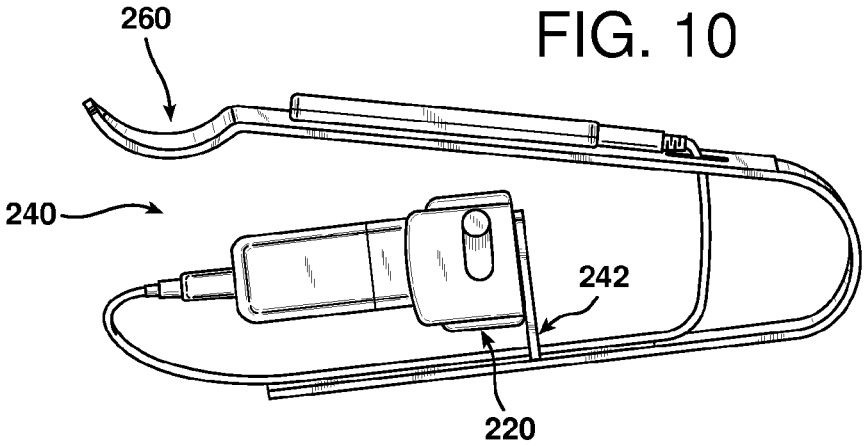
FIG. 10 is a side view illustrating the embodiment of FIG. 9.
Figure 11:
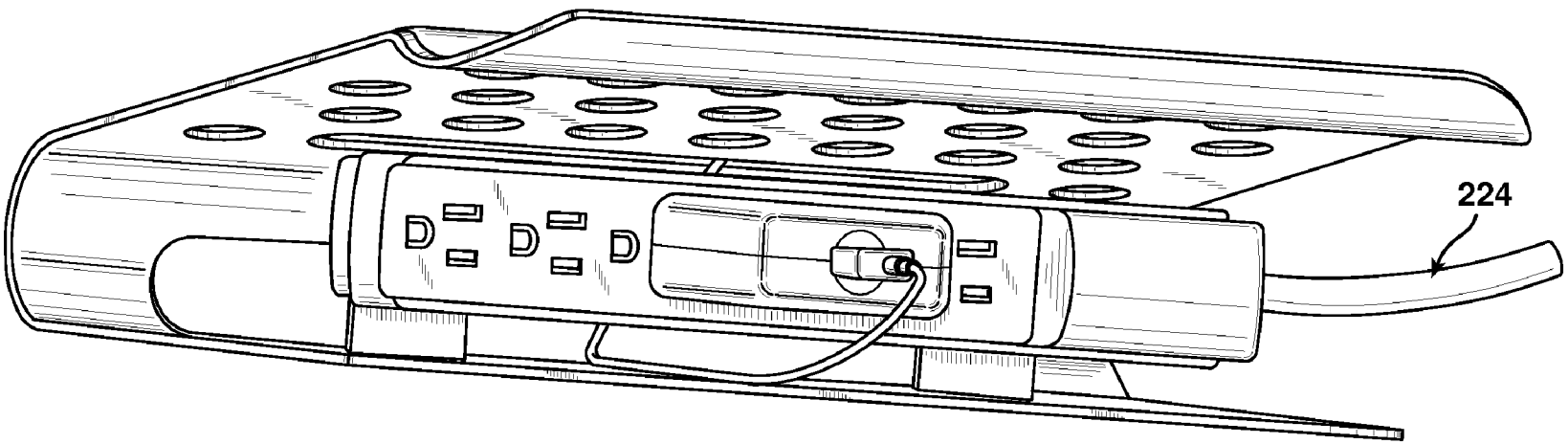
FIG. 11 is a rear view illustrating the embodiment of FIG. 9.
Figure 13:
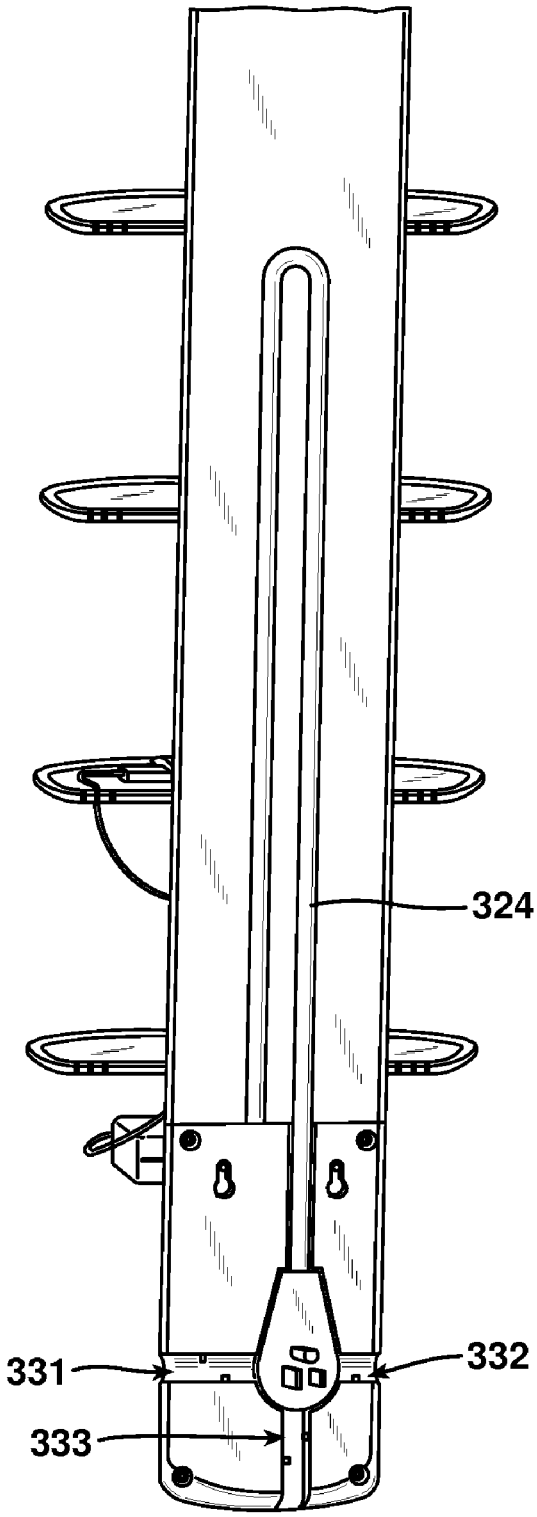
FIG. 13 is a rear view illustrating the embodiment of FIG. 12.

A third embodiment of the invention is shown in FIGS. 9-11. The support 208 is made of a shelf deck 212 and a base 214 connected along a curved spine 213. The deck 212, base 214 and spine 213 can be made of spring steel, polycarbonate, fiberglass composite or any suitable material. The deck 212 and base 214 define an inner chamber 240 (see FIG. 10) in which a conventional power strip 220 is mounted to at least one finger 242 extending from the base 214. The sockets of the power strip 220 electrically connect in a conventional manner to the cord 224 extending out of the power strip to a conventional wall outlet or other source of power. It is contemplated that the cord 224 can alternatively be wired directly into a building's conventional electrical system. Thus, any device plugged into one of the sockets will be connected in a conventional manner to the source of electrical power to which the cord 224 is connected.

The deck 212 has a plurality of apertures 250 and a slot 260 formed in it to provide openings through which cords, pens, keys and other objects can extend for holding the objects in place on the preferably tilted deck 212. The apertures permit cords and other objects to extend below the deck 212 in an organized manner and be plugged into the power strip 224. The apertures are preferably circular and the slot is an oval, but the apertures and slot can be any shape, such as triangular, rectangular, or in the shape of a "plus sign", or having a wedge-shape to permit wedging cords in place. Any number of apertures and slots can be used, in any pattern and in any location on the deck 212, as will become apparent from the description herein. A groove 260 is formed near the upper end of the deck 212 (see FIG. 10), and provides a concave surface in which items can rest that might otherwise roll down the inclined surface of the deck 212. For example, pens can be placed in the groove 260.

The support 208 preferably rests upon a horizontal surface, such as a desk, table, countertop or any other surface, and provides a space for electronic devices and other items to be stored in a neat arrangement. The deck 212 or the spine 213 can bend relative to the base 214 when heavy items are placed on the deck 212, thereby softening the impact of placing the item on the deck 212. Additionally, a high-friction, compressible mat 270, such as rubber or urethane, is attached to the upper surface of the deck 212 to reduce rolling of objects and to soften the impact of placing them on the deck 212.

A fourth embodiment of the invention is shown in FIGS. 12-17. The support 308 includes an elongated tower body 320 to which a plurality of shelves 312 are removably mounted. The body 320 has a plurality of power sockets 322 at its lower end (see FIG. 14) and a power cord 324 extending from its rear panel (see FIGS. 13 and 15). The sockets 322 electrically connect in a conventional manner to the cord 324, which extends to a conventional wall outlet or other source of power. It is contemplated that the cord 324 can alternatively be wired directly into a building's conventional electrical system. Thus, any device plugged into one of the sockets 322 will be connected in a conventional manner to the source of electrical power to which the cord 324 is connected.

Figure 12:
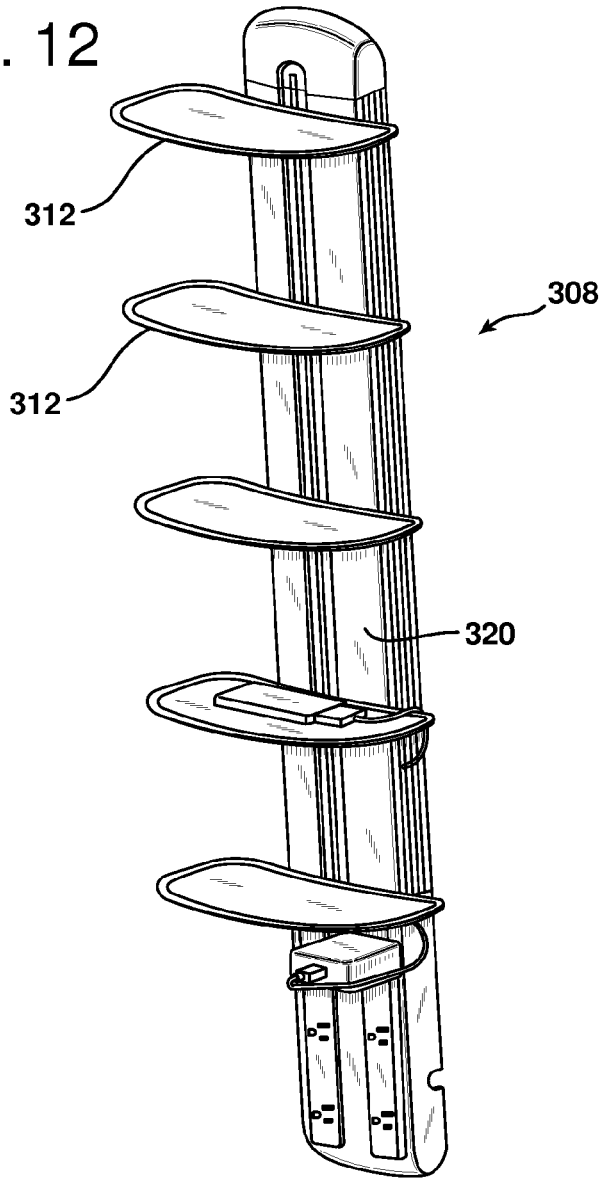
FIG. 12 is a front view illustrating a fourth embodiment of the present invention.
Figure 15:
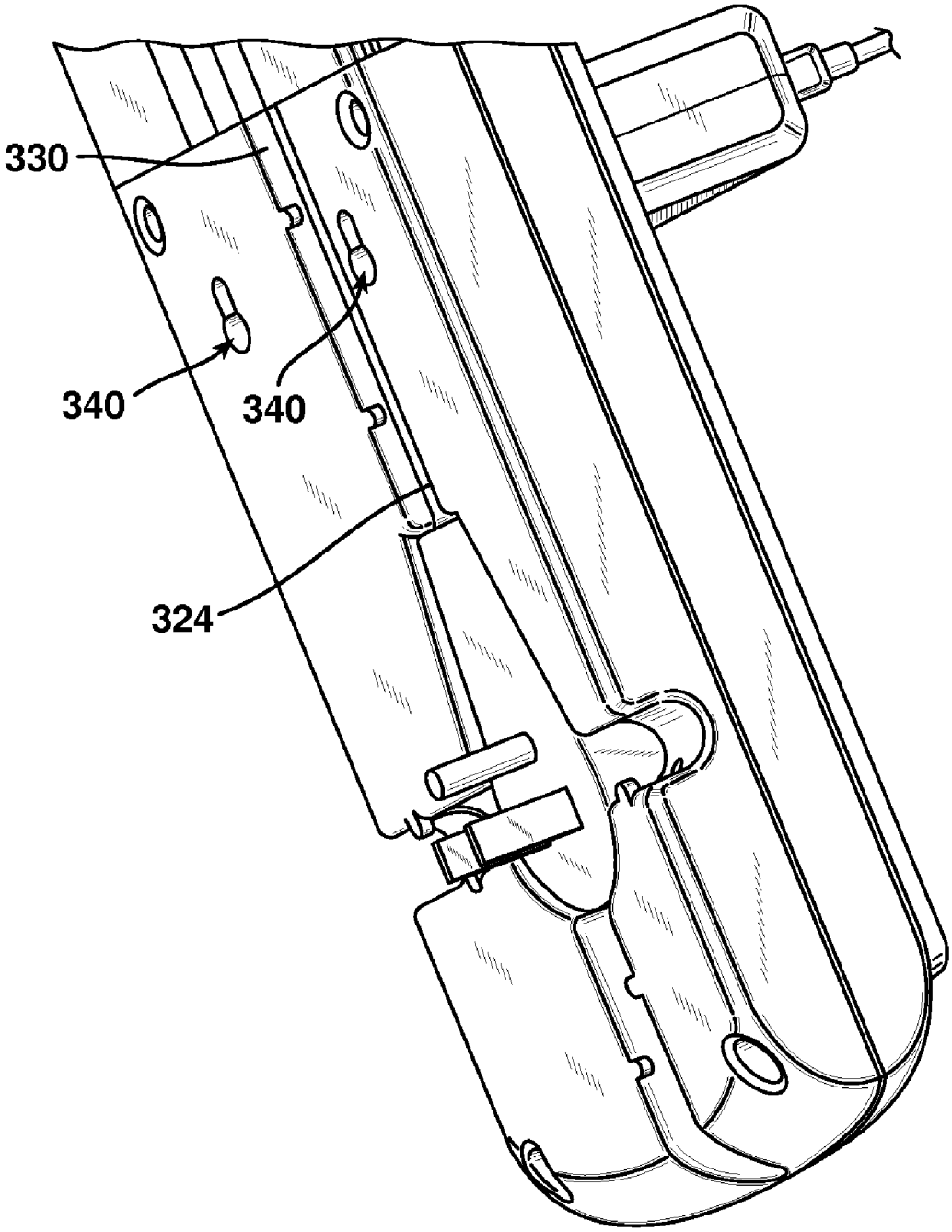
FIG. 15 is an enlarged rear perspective view illustrating the embodiment of FIG. 12.

In the embodiment shown in FIG. 12, the cord 324 and its plug are mounted in a longitudinal groove 330 in the rear of the body 320 so that the cord and plug lie below the rear surface of the body 320 so as not to create instability when mounting on a wall. The cord's prongs extend out beyond the rear of the body 320, perpendicular to the plane of the body 320 as shown in FIG. 15, so that the entire support 308 can be mounted to a wall and the prongs plugged into a conventional wall socket. Alternatively, the cord 324 can be extended to a socket that is spaced from the body 320, through any of the side grooves 331 or 332, or the bottom groove 333, while the body 320 rests against the wall with stability.

The body 320 is preferably mounted to a wall or other surface by conventional fastening means, such as keyhole slots 340, into which the heads of screws or nails mounted to the surface extend. Of course, the body 320 could be mounted in other ways to a wall or other surface, as will become apparent from this description.

Figure 4:
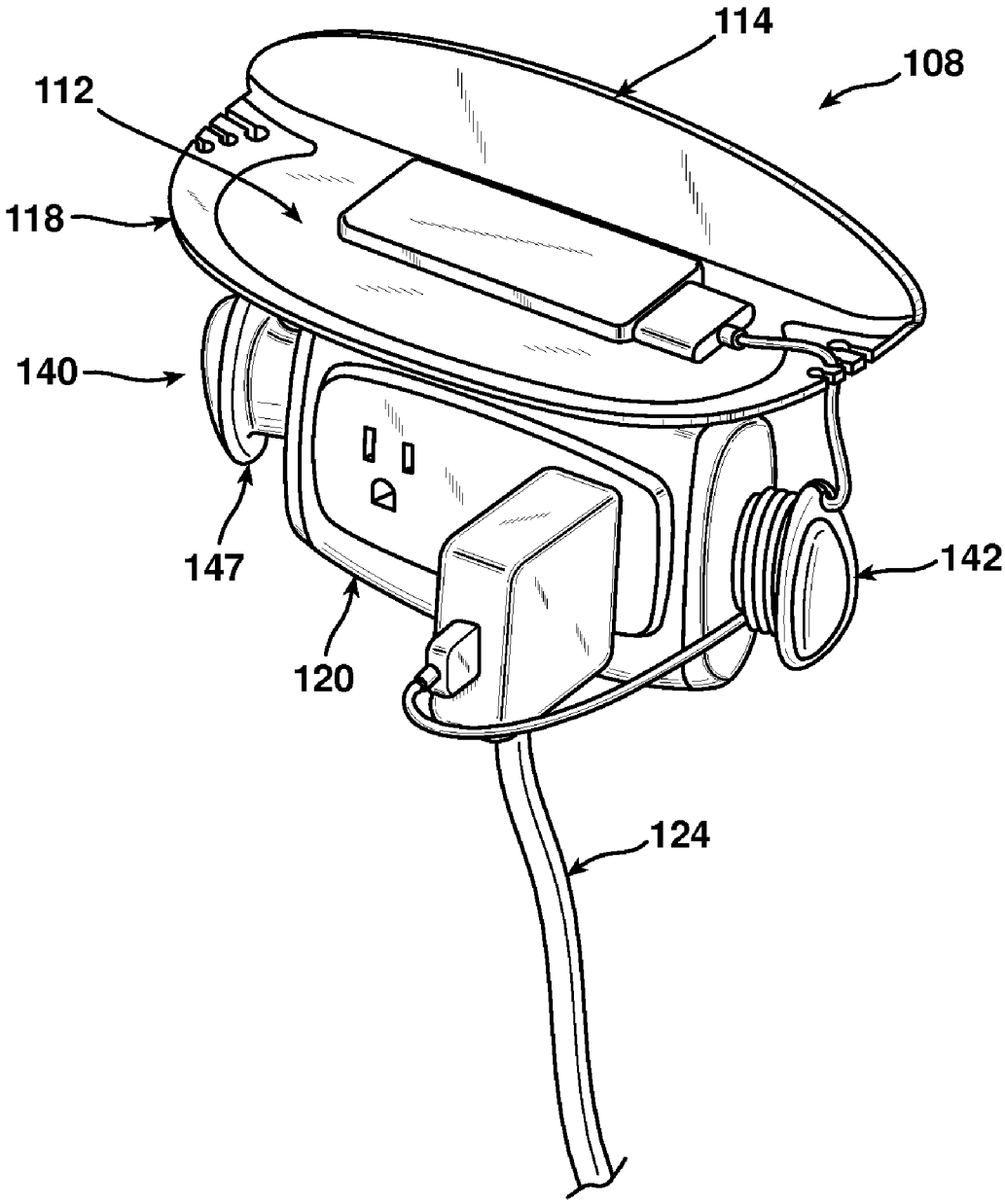
FIG. 4 is a view in perspective illustrating a second embodiment of the present invention.
Figure 5:
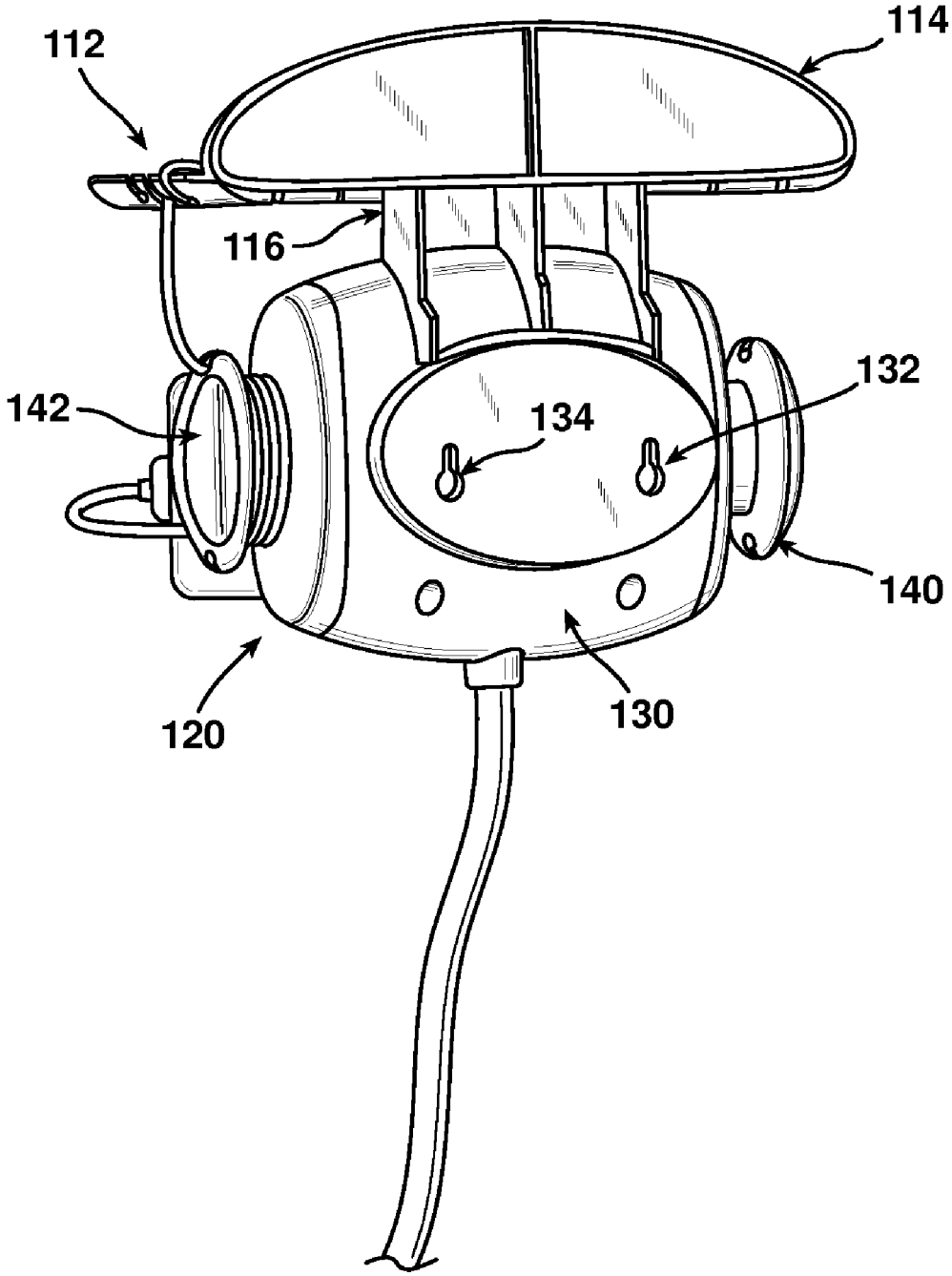
FIG. 5 is a rear view illustrating the embodiment of FIG. 4.

The shelves 312 have an overall structure similar to the shelf 112 shown in FIG. 4, including a concave upper surface, a flexible peripheral lip and one or more slits formed in the lateral edges of the lip to hold cords. The shelves 312 mount to the body 320 using cooperating structures that permit rapid movement and secure re-attachment of the shelves 312. The structures shown and described below are an example of means for removably mounting the shelves 312 to the body 320, but are not the only means. Other cooperating structures will become apparent from the description herein to the person having ordinary skill.

Figure 16:
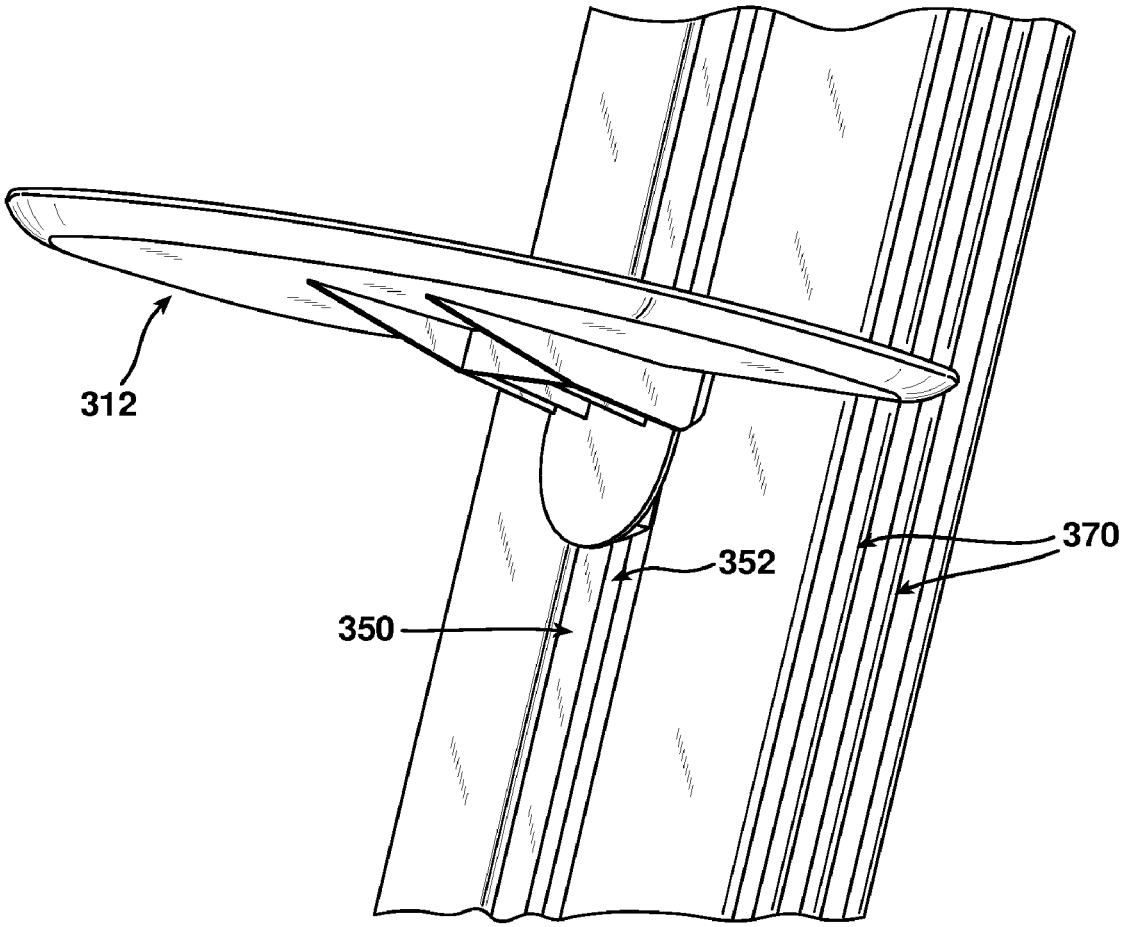
FIG. 16 is an enlarged front perspective view illustrating the embodiment of FIG. 12.
Figure 17:
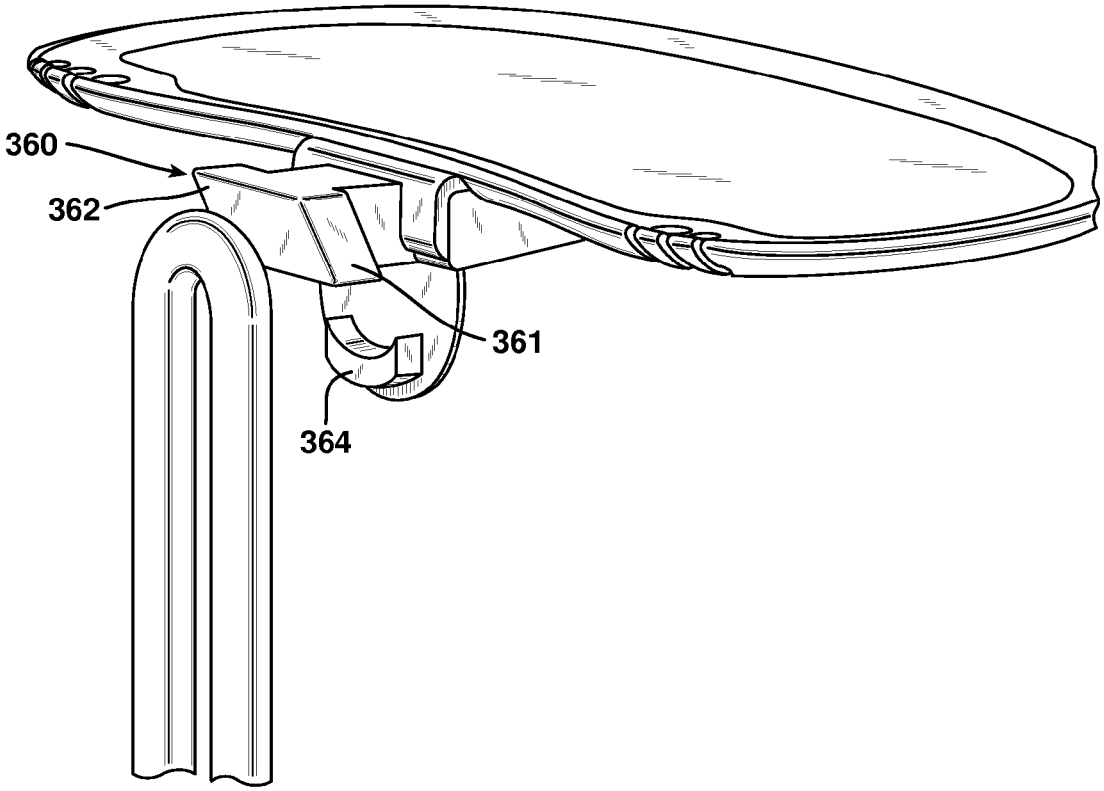
FIG. 17 is an enlarged rear schematic view of the shelf of the embodiment of FIG. 12.

Referring to FIG. 16, the body 320 has a longitudinal slot 350 extending along its front surface into which shelves 312 are inserted. The grooves 352 and 354 (the slot 354 is not visible, but is substantially identical to the slot 352 and on an opposite side of the slot 350) extend laterally from the sidewalls of the slot 350 to form a T-shaped opening (when viewed in cross section) to accept the tail 360 of the shelf 312 (FIG. 17).

The T-shaped tail 360 on the shelf 312 has two fingers 361 and 362 that extend in opposite directions from the tail 360, and have angled sidewalls. The height of the tail 360 is less than or equal to the width of the slot 350, so that the tail 360 can be placed in the slot 350 with fingers 361 and 362 parallel to the slot 350 (with the shelf oriented vertically) and inserted until the fingers 361 and 362 seat against the back of the slot 350. The shelf 312 is then rotated to insert the fingers 361 and 362 into the grooves 352 and 354. The sidewalls of the grooves 352 and 354 hold the tail 360 and fingers in place by a frictional engagement. Of course, there are many alternative structures that can accomplish the attachment of the shelves 312 to the tower body 320.

The lip 364 is substantially the same width as the slot 350 so that when the shelf 312 is rotated to its operable position shown in FIG. 16, the lip 364 extends into the slot 350 and inhibits rotation of the shelf 312. However, upon the application of sufficient torque to the shelf 312, the lip 364 is removed from the slot 350 and the shelf 312 can be repositioned wherever desired. The lip 364 further reduces the probability that the shelves will unintentionally rotate and fall from the body 320.

Figure 14:
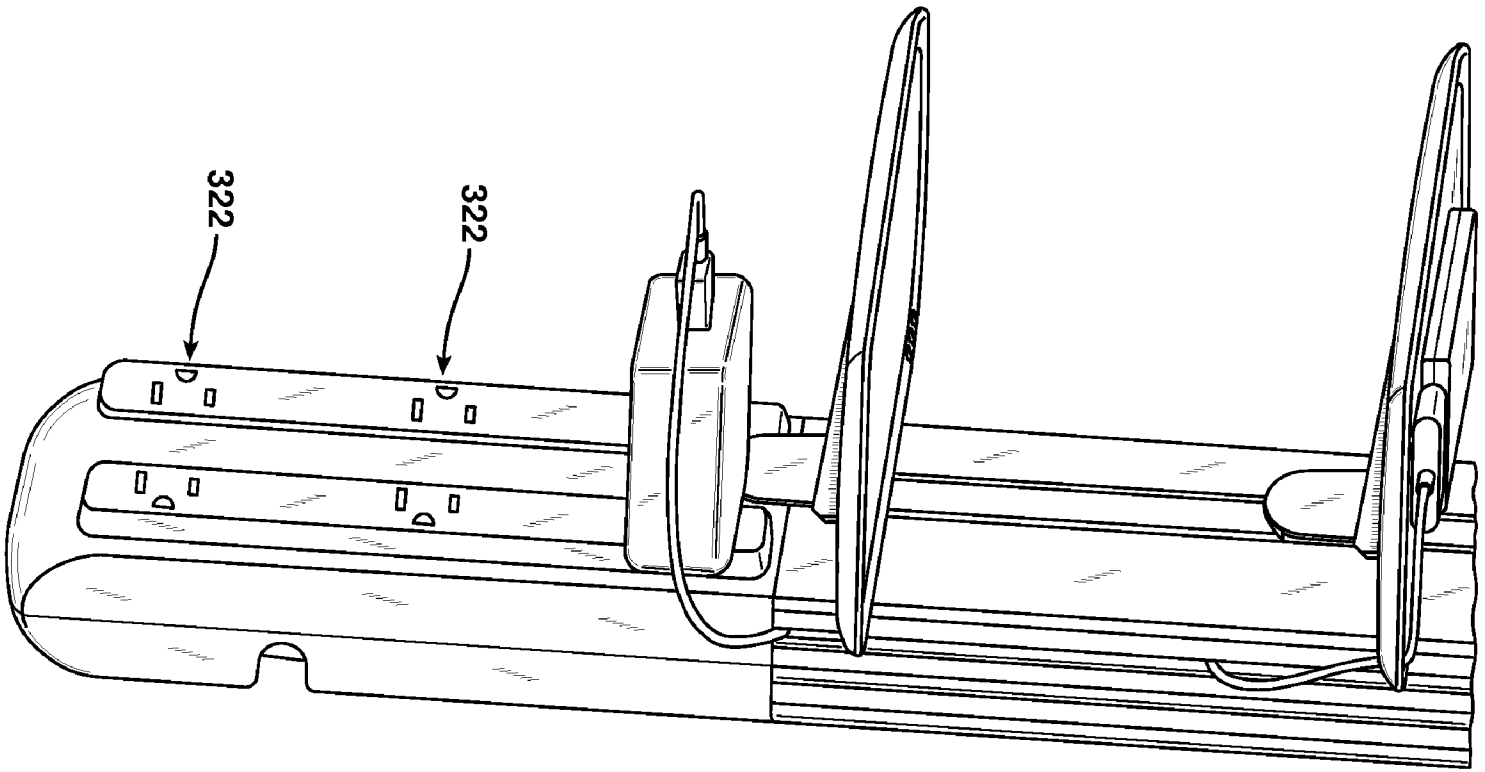
FIG. 14 is an enlarged side perspective view illustrating the embodiment of FIG. 12.

The longitudinal channels 370 are formed on the lateral edges of the body 320 to accept cords extending from the shelves 312 to the sockets 322. The channels 370 prevent entanglement of the cords, and provide a pleasing appearance to the apparatus, because each channel 370 has a flexible wiper that covers the channel. Each wiper is either pivotably mounted to one edge of each channel, or, more preferably, a flexible material, such as rubber or urethane, and is mounted at one edge to the edge of a corresponding channel. The wiper bends out of the way to accept a cord pushed into the channel, and then bends back due to the material's memory to close the channel once the cord is completely inserted. This is illustrated in FIG. 14.

In use, the support 308 is mounted to a wall or other vertical structure and then plugged in. The shelves 312 are positioned to the desired height, and electronic devices are placed on the shelves. The cords for the devices are then extended from the shelves to the sockets 322 and plugged in. The cords are inserted into the channels 370 to hide them from view and prevent entanglement. The shelves 312 can be adjusted for the most pleasing appearance or based upon cord lengths. Any number of shelves can be used, but between three and five is contemplated.

It should be noted that there are many alternative structures to those described above, as will become apparent from the description. For example, any cord that is illustrated as straight could be coiled. Additionally, the groove shown in the FIG. 10 embodiment can be moved to the lower portion of the deck, or anywhere else on the deck.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A power cord management apparatus for electronic devices, the apparatus comprising a shelf and a base connected along a curved spine defining an inner chamber between the shelf and the base, wherein the shelf is cantilevered relative to the base, the sides and the back of the apparatus are open, an electrical outlet is mounted in the chamber, and the shelf has a plurality of apertures formed through it extending into the inner chamber.

2. The apparatus of claim 1, further comprising at least one finger extending from the base into the inner chamber to which the outlet is mounted.

3. The apparatus of claim 2, wherein the at least one finger is formed from a portion of the base that has been cut and bent into the inner chamber.

4. The apparatus of claim 2, further comprising a concave groove formed in the shelf for preventing items from rolling off the shelf.

5. The apparatus of claim 2, wherein a layer of high friction, shock absorbent material is mounted to a top surface of the shelf.

* * * * *